US006431913B1

(12) United States Patent
Mahoney

(10) Patent No.: US 6,431,913 B1
(45) Date of Patent: Aug. 13, 2002

(54) SELF ALIGNING, WEATHER RESISTANT ELECTRICAL SWITCH

(75) Inventor: William G. Mahoney, Suwanee, GA (US)

(73) Assignee: Scientific-Atlanta, Inc., Lawrenceville, GA (US)

( * ) Notice: Subject to any disclaimer, the term of this patent is extended or adjusted under 35 U.S.C. 154(b) by 0 days.

(21) Appl. No.: 09/746,760

(22) Filed: Dec. 21, 2000

(51) Int. Cl.[7] ..... H01R 13/40
(52) U.S. Cl. ..... 439/603; 200/51.12
(58) Field of Search ..... 200/51 R, 51.12, 200/51.14, 51.17, 51.09, 43.03, 43.04; 439/603, 46, 52

(56) References Cited

U.S. PATENT DOCUMENTS 2,048,848 A * 7/1936 De Tar ..... 200/1 R
3,739,114 A * 6/1973 Palman ..... 200/43.08

* cited by examiner

*Primary Examiner*—Brian Sircus
*Assistant Examiner*—Phuong K T Dinh
(74) *Attorney, Agent, or Firm*—Hubert J. Barnhardt, III; Kenneth M. Massaroni; Shelley L. Couturier

(57) ABSTRACT

An electrical connector (305) with a conductive contact (420) that self-aligns via formed notches (425). The contact (420) also includes an opening (503) formed in a central region thereof for mating with a snap protrusion within an insulator (415) and flexibly holding it in place allowing the contact (420) to float within the insulator (415). The connector (305) additionally includes a plug that is inserted and retained into an aperture formed in the insulator (415). The connector (305) is rotated and electrically couples the contact (420) with the conductive member (310), thereby allowing alternating current (AC) power to flow through the connector (305).

14 Claims, 4 Drawing Sheets

SELF ALIGNING, WEATHER RESISTANT ELECTRICAL SWITCH

RELATED APPLICATIONS

This patent application is related to U.S. patent application Ser. No. 09/747,536, entitled Electrically and Environmentally Sealed Mechanical Control Device for an Electronic Device by David Wallis et al., and filed on even date with this patent application.

FIELD OF THE INVENTION

This invention relates generally to broadband communication systems, such as cable television systems, and taps used in such systems, and more specifically to the provision of AC power to subscriber premises in a broadband communication system.

BACKGROUND OF THE INVENTION

A communication system 100, such as a two-way cable television system, is depicted in FIG. 1. The communication system 100 includes headend equipment 105 for generating forward signals that are transmitted in the forward, or downstream, direction along a communication medium, such as a fiber optic cable 110, to an optical node 115 that converts optical signals to radio frequency (RF) signals. The RF signals are further transmitted along another communication medium, such as coaxial cable 120, and are amplified, as necessary, by one or more distribution amplifiers 125 positioned along the communication medium. Taps 130 included in the cable television system split off portions of the forward signals for provision to subscriber equipment 135, such as set top terminals, computers, and televisions. In a two-way system, the subscriber equipment 135 can also generate reverse signals that are transmitted upstream, amplified by any distribution amplifiers 125, converted to optical signals, and provided to the headend equipment 105.

A cable television tap 130 that splits the forward signal is depicted in FIG. 2. The tap 130 includes an input port 205 for receiving the signal, an output port 210 for passing the signal through to other portions of the communication system 100, and subscriber ports 215, each of which couples a portion of the signal to subscriber equipment. A tap 130 commonly includes four, eight, or sixteen subscriber ports 215, although an even larger number of subscriber ports 215 can be included if necessary.

AC (alternating current) power can also be provided through the cable television system 100 for powering telephones and other subscriber equipment. In this case, the AC power typically travels through the same distribution system, including the taps 130, so that it can be provided to the subscriber equipment on the same communication medium that provides the information signal. In operation, the tap 130, which includes a power distribution unit (PDU) 220, receives the forward signal, including the AC power, and provides, via AC port device connectors 225, a plurality of AC power outputs and, via the subscriber ports 215, a plurality of information signal outputs.

While the conventional multimedia tap 130, which includes the PDU 220, meets the objective of providing information signals while also supplying AC power to the subscriber, there are some disadvantages presented by the conventional tap 130. To activate a conventional PDU 220, the cover 230 needs to be removed via a number of screws or fasteners. Each connector 225 has an associated internal power jumper (not shown). The power jumpers are positioned in either the pass position, which activates an AC port device connector 225, or in a block position, which disables any power flow through a particular connector 225. There are several disadvantages with this method of supplying power to the subscribers. One disadvantage is the necessity of removing the PDU cover 230 to access the internal jumpers. A second disadvantage is the possibility of dropping a jumper as a result of having to physically remove and reposition the jumper to either the pass or block position. Typically, a large proportion of the installed taps 130 are hanging on aerial cable within the cable system 100. To access a tap 130 that is aerially installed is costly; in addition, if a jumper is dropped to the ground while repositioning, the operator consumes much time in either locating the jumper on the ground or preparing another jumper for its replacement.

In light of the disadvantages to the cable operator, what is needed is a less cumbersome multimedia tap 130 that offers flexibility in the distribution of AC power.

A product is needed that incorporates the required specifications for passing AC power to the subscriber, but also enhances the product with user-friendly features.

DETAILED DESCRIPTION OF A PREFERRED EMBODIMENT

Figure 1:
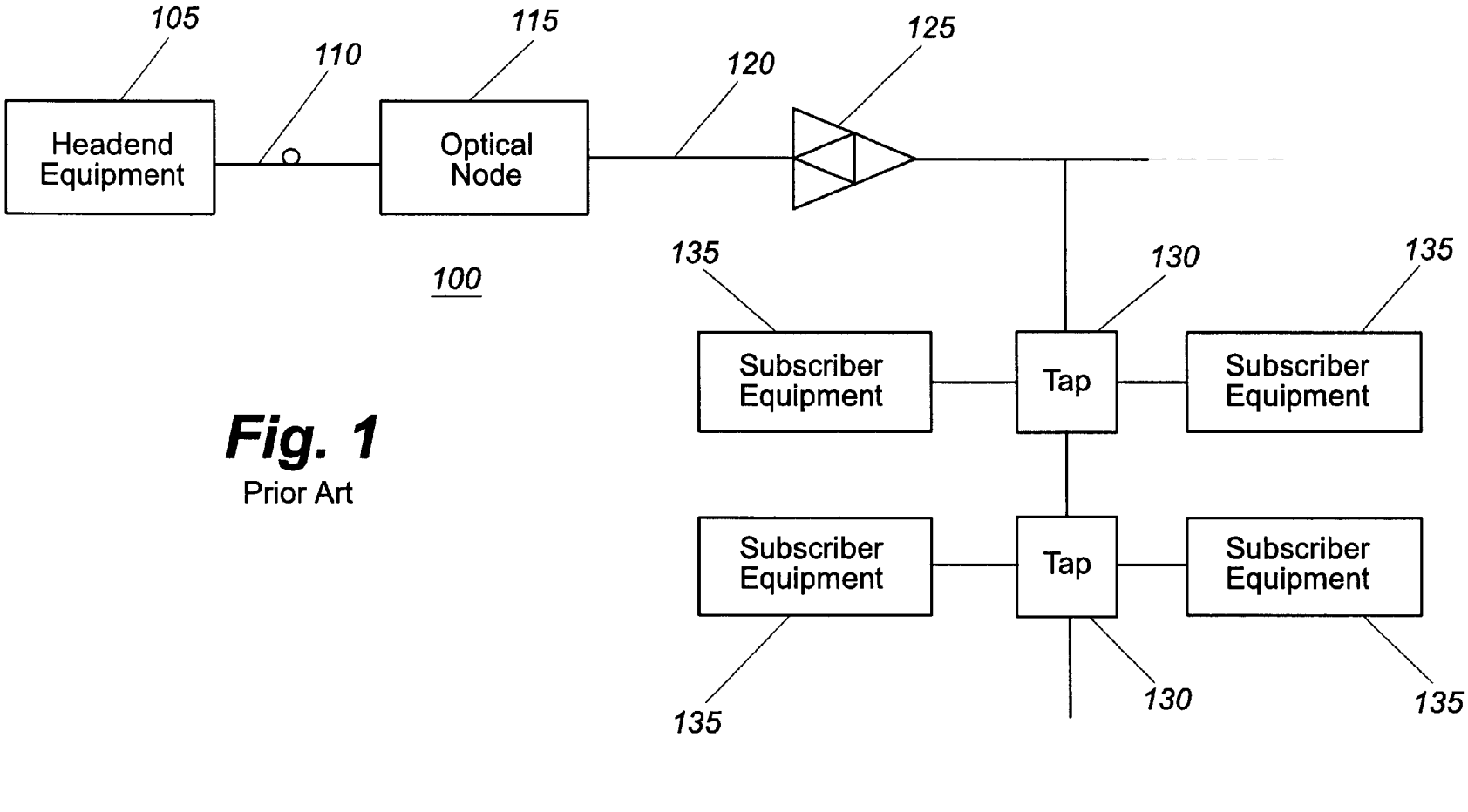
Fig. 1 Prior Art
FIG. 1 is a block diagram of a conventional communication system, such as a cable television system.
Figure 2:
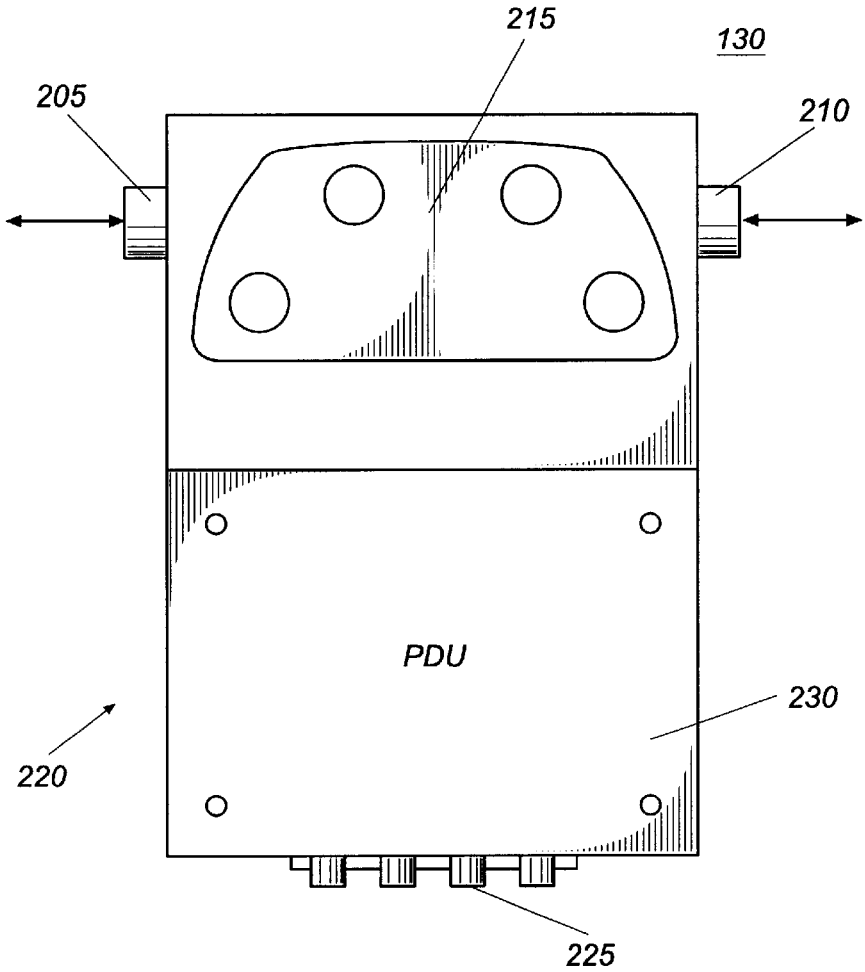
Fig. 2 Prior Art
FIG. 2 is an illustration of a conventional multimedia tap including a power distribution unit that is used in such systems as shown in FIG. 1.
Figure 3:
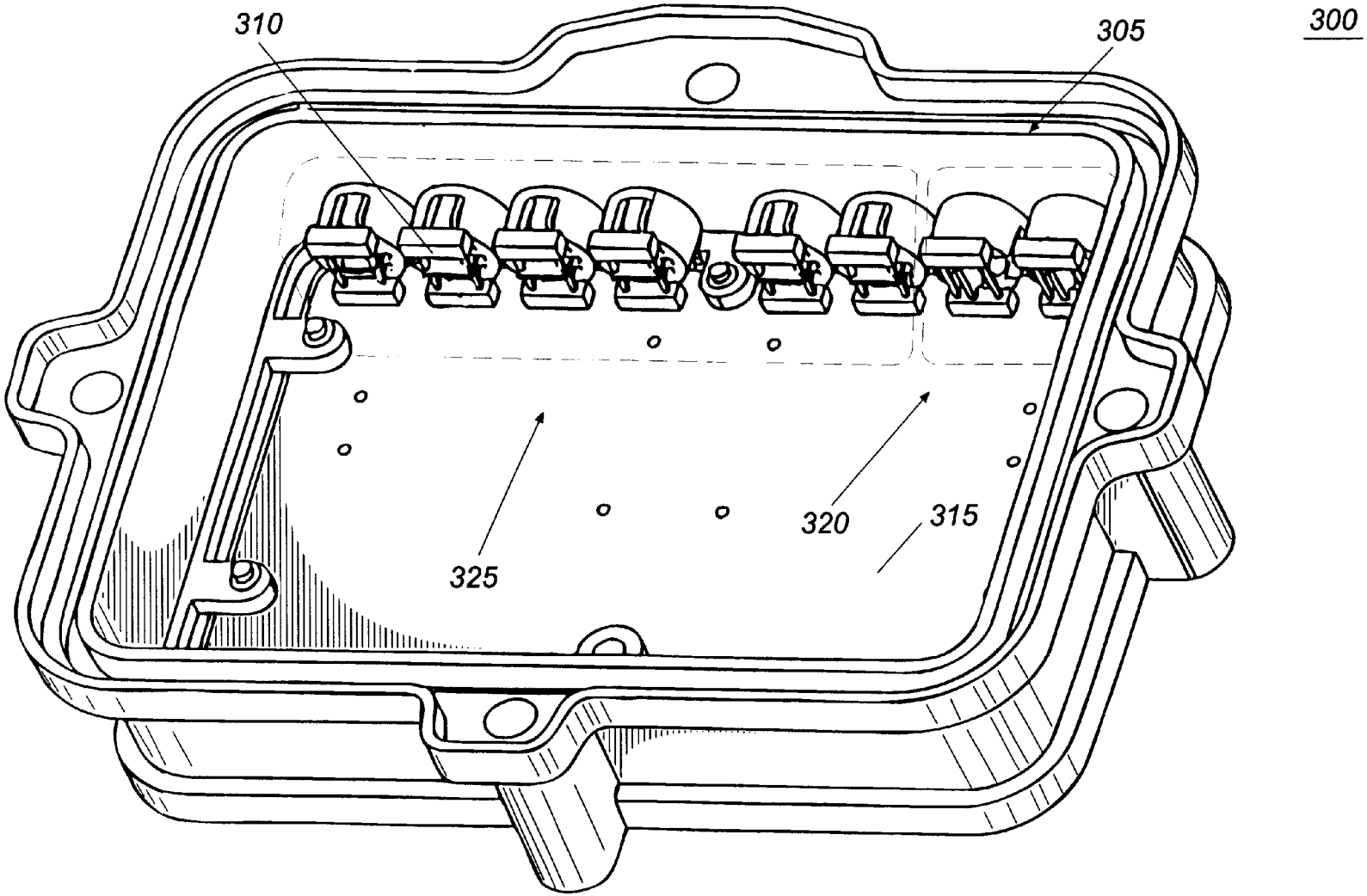
FIG. 3 is an illustration of a power distribution unit with electrical connectors in accordance with the present invention.

Referring to FIG. 3, an illustration depicts an electrical device 300, such as a power distribution unit (PDU), including electrical connectors 305 for providing AC power therethrough in accordance with a preferred embodiment of the present invention. The PDU 300, through use of the connectors 305, offers the cable operator flexibility in distributing AC power to subscribers. FIG. 3 illustrates the PDU 300 with the cover removed to show the inside of the unit 300 and the internal exposed portions of the connectors 305. It will be appreciated, however, that in accordance with the present invention, external access to the connectors 305 enable the operator to either position each of the connectors 305 in the pass or block positions. More specifically, the PDU 300 is designed with the flexibility of positioning the connectors 305 in the desired position without removing the cover, therefore saving time and money in comparison with use of the conventional PDU 220 (FIG. 2).

In addition to the connectors 305 illustrated in FIG. 3, the PDU 300 includes conductive members 310, such as header pins, which, for example, can by comprised of two horizontal pins, that are soldered, or press-fit, into a printed circuit board 315. Each header 310 corresponds to a connector 305. In operation, the connectors 305 initially are in a blocked position that prevents AC power from passing through to the subscriber equipment that are connected to each connector 305. In this position, the connector 305 is not electrically coupled to, or in physical contact with, the header 310. When the connector 305 is rotated a half turn, the connector 305 is moved into a pass position and, therefore, couples to the header pins 310, subsequently allowing AC power to pass through the PDU 300, through the connector 305, and through the cable to the subscriber equipment.

Figure 4:
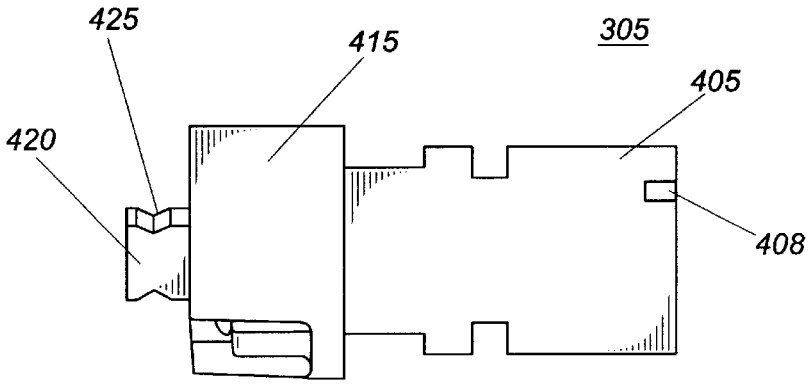
FIG. 4 is an illustration of an electrical connector used in the power distribution unit shown in FIG. 3 in accordance with the present invention.

Referring to FIG. 4 in conjunction with FIG. 3, an assembled connector 305 is illustrated. The connector 305 includes a switch element that can be plugged into (and through) the PDU housing. The switch element, or plug 405, can be formed using any type of material, e.g., plastic or metal. A portion of the plug 405 is accessible from the exterior of the PDU housing, and preferably extends from the PDU housing for convenient access outside of the unit 300. The exposed portion has a slot 408 or groove formed in the top for inserting a conventional screwdriver, or some other tool, to rotate the connector 305 in the desired direction. The plug 405 is connected to a retainer 415, which extends within the housing. The retainer is made from a nonconductive material, such as plastic or Teflon.

Extending from the opposite end of the connector 305, and partially enclosed within the retainer 415, is a conductive contact 420 for electrically coupling with the header pins 310 (FIG. 3). The contact 420 has notches 425 formed on the extended portion to enable rotation of the connector 305 within the two pins of the header 310 into either the pass or block position. Since the header pins 310 have a defined distance between the two pins, the notches 425 in the contact 420 are designed to allow rotation between them. When the contact 420 is in a vertical position, which is in the same plane as the header pins, there is no electrical contact between the pins 310 and the contact 420. When the plug 405 is turned a half rotation, the contact 420 turns to a horizontal position, wherein the header pins 310 are centered within the notches 425, making electrical contact and allowing AC power to pass through the connector 305.

Figure 6:
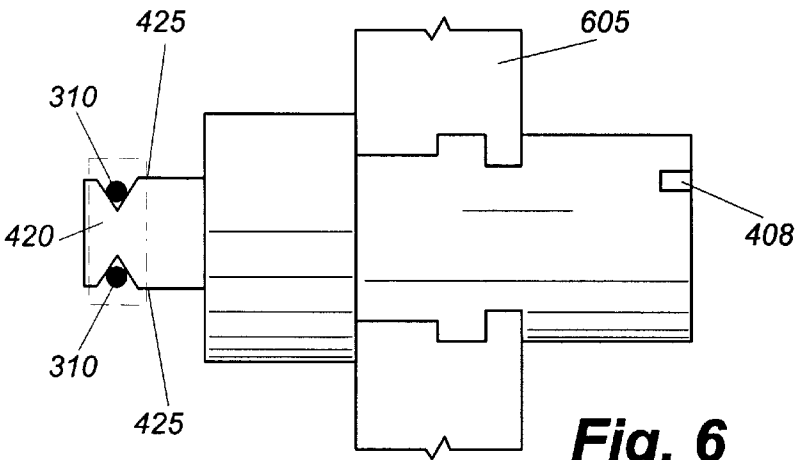
FIG. 6 depicts a cutout view showing the assembly of the electrical connector retained within a housing, wherein the electrical connector is electrically coupled with conductive elements in accordance with the present invention.
Figure 7:
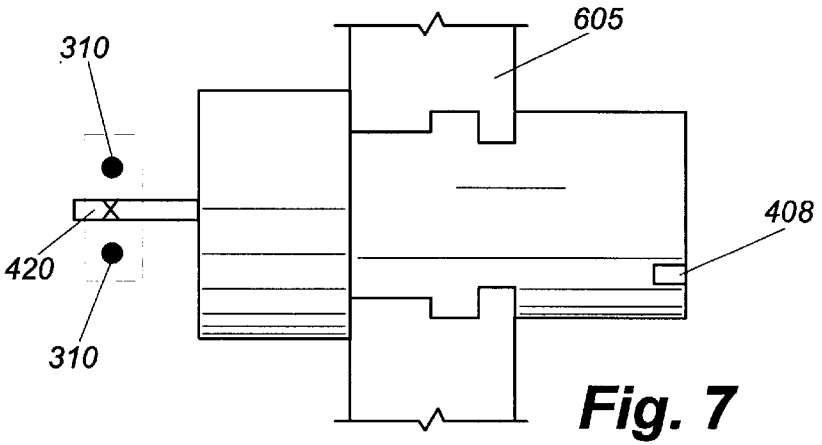
FIG. 7 depicts a second cutout view showing the assembly of the electrical connector retained within a housing, wherein the electrical connector is not coupled to conductive elements.

Referring again to FIG. 3, the illustration depicts connectors 305 that are in the block position 320 and in the pass position 325. The connectors 305 in the block position 320 do not allow AC power to pass through. In this position, the contact 420 (FIG. 4) is vertically positioned between the two header pins 310. The connectors 305 in the pass position 325 allow AC power to pass through to the subscribers. In this position, the contact 420 is horizontally positioned between the two header pins making electrical contact. More specifically, referring to FIG. 6 in conjunction with FIG. 3, shows the top, cutout view of a connector 305 installed within an opening in the PDU housing 605. In this illustration, the groove 408 in the accessible portion of the connector 305 is rotated such that AC power is passing through to the subscriber equipment. In this case, the notches 425 are rotated to make electrical contact with the pins 310 of the header (FIG. 3). The pins 310 are coupled to conventional circuitry within the PDU 300, thereby allowing the AC power to pass. In contrast, FIG. 7 shows the top, cutout view of the connector 305 rotated a half turn via the groove 408, subsequently, rotating the contact 420 and thereby preventing contact with the pins 310 and not allowing AC power to pass through to the subscriber equipment. It will be appreciated that each of the connectors 305 (FIG. 3) can be repositioned at any given time by a technician.

Figure 5:
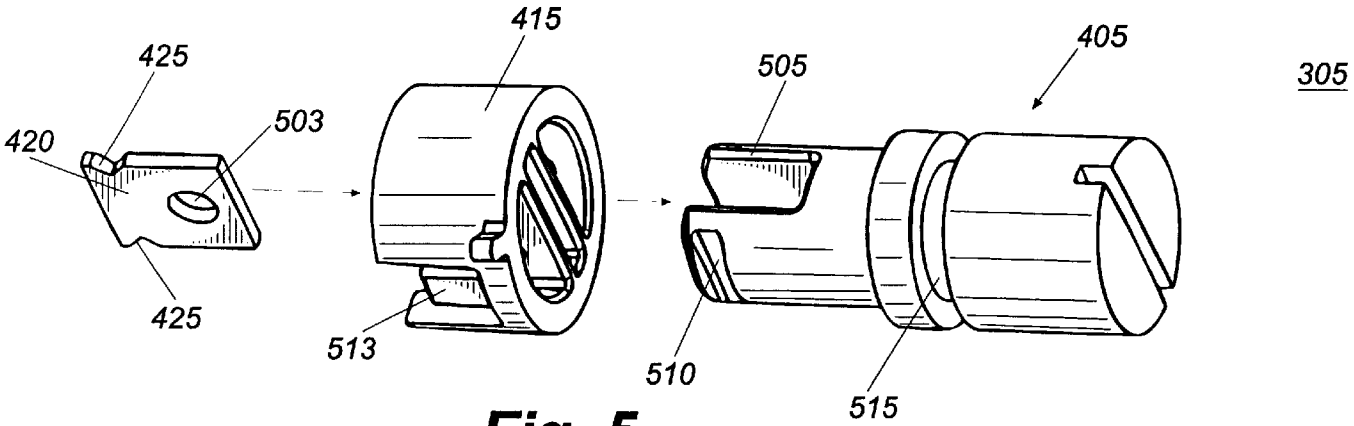
FIG. 5 depicts the configuration of the electrical connector of FIG. 4 in accordance with the present invention.

FIG. 5 depicts the assembly of the connector 305. The contact 420 is inserted into the retainer 415. The retainer 415 is designed with cantilever snap features that allow the contact 420 to be inserted without the need for external hardware. More specifically, the contact 420 is captivated in the retainer 415 with a snap lever protrusion (not shown) that is intentionally smaller than the mating hole 503 in the contact 420. The oversized hole 503 and the notches 425 allow the contact 420 to float within the retainer 415 so that the contact 420 self-aligns between the two header pins 310 when actuated. These two features of the contact 420 accommodate a large tolerance in measurements of the assembled based on standard manufacturing processes.

In addition, the retainer 415 insulates the contact 420 from the plug 405. The retainer 415 and contact 420 are then inserted onto the plug 405, where a formed bridge within the center of the retainer 415 is cut out to allow the bottom legs 505 to snap in place. Again, notches 510 formed on the legs 505 snap and hold into place with a cantilever snap 513 30 within the retainer 415. Also formed into the plug 405 is a groove 515 for a weather resistant o-ring. Due to the exterior access to the connectors 305, it is important to not allow the weather to affect the electronics within the PDU 300. The assembled connector 305 is then inserted into the PDU housing.

The preferred embodiment of the present invention described above is a low-cost implementation for supplying AC power to, and disconnecting AC power from, the subscriber equipment without having to open the PDU cover 230 (FIG. 2). In summary, the present invention allows the operator savings in time and money due to its flexibility in use and operation.

What is claimed is:

1. An electrical connector, comprising:

a conductive contact having notches formed therein at a first end and an opening formed therethrough;

an insulative retaining member into which the contact is inserted, the retaining member for mating with the opening in the contact to hold the contact within the retaining member and further including at least one aperture formed therein; and a switch element having first and second ends, the first end having an extended portion that is inserted into the at least one aperture of the retaining member to secure the retaining member to the switch element, and the second end including rotating means for rotating the switch element, wherein rotation of the switch element rotates the electrical connector from an open position to a closed position.

2. The electrical connector of claim 1, wherein, when the electrical connector is properly installed in an external electrical device, the contact is aligned with conductive members of the external electrical device; wherein rotation of the electrical connector into the open position decouples the contact from the conductive members, thereby interrupting current flow between the conductive members; and wherein rotation of the electrical connector into the closed position couples the contact to the conductive members to form an electrical path between the conductive members.

3. The electrical connector of claim 2, wherein, when the electrical connector is in the closed position, the contact is positioned to secure the conductive members within the notches formed in the contact.

4. The electrical connector of claim 3, wherein, when the electrical connector is installed in the external electrical device, the contact and retaining member are held within the external electrical device, and the rotating means of the switch element is accessible from an exterior of the external electrical device.

5. The electrical connector of claim 4, wherein the rotating means of the switch element comprises a slot formed therein.

6. An electrical device for processing an electrical signal, the electrical device comprising:

conductive members for conducting the electrical signal;

a housing for enclosing the conductive members, the housing having an opening formed therethrough; and an electrical connector installed through the opening in the housing, the electrical connector comprising:

a conductive contact having notches formed therein at a first end and an opening formed therethrough, wherein the contact is aligned with the conductive members;

an insulative retaining member into which the contact is inserted, the retaining member for mating with the opening in the contact to hold the contact within the retaining member and further including at least one aperture formed therein; and a switch element having first and second ends, the first end having an extended portion that is inserted into the at least one aperture of the retaining member to secure the retaining member to the switch element, and the second end including rotating means for rotating the switch element, wherein rotation of the switch element rotates the electrical connector from an open position to a closed position, and wherein the rotating means is accessible from the exterior of the housing.

7. The electronic device of claim 6, wherein rotation of the electrical connector into the open position decouples the contact from the conductive members, thereby interrupting current flow between the conductive members, and wherein rotation of the electrical connector into the closed position couples the contact to the conductive members to form an electrical path between the conductive members.

8. The electronic device of claim 7, wherein, when the electrical connector is in the closed position, the contact is positioned to secure the conductive members within the notches formed in the contact.

9. The electronic device of claim 8, wherein the rotating means of the switch element comprises a slot formed therein.

10. The electronic device of claim 9, wherein the electronic device comprises a power distribution unit.

11. The electronic device of claim 9, wherein the electronic device comprises a tap for use in a communication system.

12. The electronic device of claim 9, wherein the electrical signal conducted by the conductive members comprises an alternating current (AC) signal.

13. The electronic device of claim 9, wherein the electrical connector further comprises securing means for securing the electrical connector to the housing of the electronic device.

14. The electronic device of claim 9, wherein:

the first end of the switch element has a first diameter, the second end of the switch element has a second diameter greater than the first diameter, and the retaining member has a third diameter greater than the first diameter;

the opening in the housing has a fourth diameter that is greater than the first diameter and that is less than the second and third diameters such that, when the switch element is assembled to the retaining member, the electrical connector is secured to the housing of the electronic device.

* * * * *

UNITED STATES PATENT AND TRADEMARK OFFICE

CERTIFICATE OF CORRECTION

PATENT NO. : 6,431,913 B1
DATED : August 13, 2002
INVENTOR(S) : Mahoney

It is certified that error appears in the above-identified patent and that said Letters Patent is hereby corrected as shown below:

Column 4,
Line 22, delete "513 30" and insert therefore -- 513 --

Signed and Sealed this

Twenty-sixth Day of November, 2002

*Attest:*

*Attesting Officer*

JAMES E. ROGAN
*Director of the United States Patent and Trademark Office*